US008701225B1

(12) United States Patent
Latiff

(10) Patent No.: US 8,701,225 B1
(45) Date of Patent: Apr. 22, 2014

(54) UNDER PAD WITH INTEGRAL HANDLES

(71) Applicant: Bibi-Akleema Latiff, Miami, FL (US)

(72) Inventor: Bibi-Akleema Latiff, Miami, FL (US)

(73) Assignee: Azeema Latiff, Miami, FL (US)

( * ) Notice: Subject to any disclaimer, the term of this patent is extended or adjusted under 35 U.S.C. 154(b) by 0 days.

(21) Appl. No.: 13/781,703

(22) Filed: Feb. 28, 2013

(51) Int. Cl.
*A61G 7/14* (2006.01)
*A47G 9/02* (2006.01)

(52) U.S. Cl.
USPC ..... 5/81.1 T; 5/81.1 R; 5/484

(58) Field of Classification Search
USPC ..... 5/83.1, 81.1 R, 81.1 T, 89.1, 625, 627, 5/484, 417, 420, 81.1 HS
See application file for complete search history.

(56) References Cited

U.S. PATENT DOCUMENTS

| | | | | |
|---|---|---|---|---|
| 2,015,391 | A * | 9/1935 | Anderson | 5/627 |
| 2,835,902 | A * | 5/1958 | Fash | 5/627 |
| 4,813,944 | A * | 3/1989 | Haney et al. | 604/358 |
| 5,099,532 | A * | 3/1992 | Thomas et al. | 5/484 |
| 5,214,813 | A * | 6/1993 | Gastle et al. | 5/625 |
| 5,333,335 | A * | 8/1994 | Gastle et al. | 5/625 |
| 5,787,523 | A * | 8/1998 | Lindberg | 5/81.1 HS |
| 6,073,287 | A * | 6/2000 | Svensson | 5/625 |
| 6,367,427 | B1 * | 4/2002 | Canady | 119/857 |
| D610,491 | S * | 2/2010 | Singleton et al. | D12/128 |
| D622,399 | S * | 8/2010 | Veon | D24/183 |
| 2005/0055768 | A1 * | 3/2005 | Assink | 5/81.1 R |
| 2007/0056096 | A1 * | 3/2007 | Assink | 5/81.1 HS |

* cited by examiner

*Primary Examiner* — Robert G Santos

(57) ABSTRACT

A reusable, washable, absorbent under pad has built-in handles to aid in the transfer and accommodation of bed-bound or chairbound patients, for example. The under pad can have at least two handles on each side thereof to facilitate transfer of patients by caregivers and to facilitate proper body mechanics, thereby preventing work related and home injuries by caregivers.

10 Claims, 4 Drawing Sheets

10

UNDER PAD WITH INTEGRAL HANDLES

BACKGROUND OF THE INVENTION

The present invention relates to patient care devices and, more particularly, to a reusable, washable absorbent under pad with built-in handles to enable caregivers to move and transfer patients with ease.

Often, to move or transfer a patient that is either bedbound or chairbound, a caregiver may use a sheet and bunch up the sides to provide a place to grip the sheet to then move or carry the patient. This may be difficult, due to the lack of a good grip, and potentially dangerous, as the sheet may come unbunched and slip, suddenly moving the patient.

Current products on the market do not have built-in handles and require the user to make a grip on a make-shift patient moving device.

As can be seen, there is a need for improved devices for transferring and accommodating bedbound or chairbound patients.

SUMMARY OF THE INVENTION

In one aspect of the present invention, an under pad comprises a top layer; an absorbent layer disposed adjacent the top layer; a non-porous waterproof bottom layer disposed adjacent the absorbent layer; and at least two handles on opposite sides of the under pad, the handles having a foam layer disposed below the absorbent layer and about a handle opening.

In another aspect of the present invention, an under pad comprises a top layer; an absorbent layer adjacent the top layer, the top layer quilted into the absorbent layer; a non-porous waterproof bottom layer disposed adjacent the absorbent layer; at least two handles on each of two opposite sides of the under pad; and a foam layer disposed below the absorbent layer and about a handle opening, wherein the foam layer is stitched into the top layer, the absorbent layer and the non-porous waterproof bottom layer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a reusable, washable, absorbent under pad with built-in handles to aid in the transfer and accommodation of bedbound or chairbound patients, for example. The under pad can have at least two handles on each side thereof to facilitate transfer of patients by caregivers and to facilitate proper body mechanics, thereby preventing work related and home injuries by caregivers.

Figure 4:
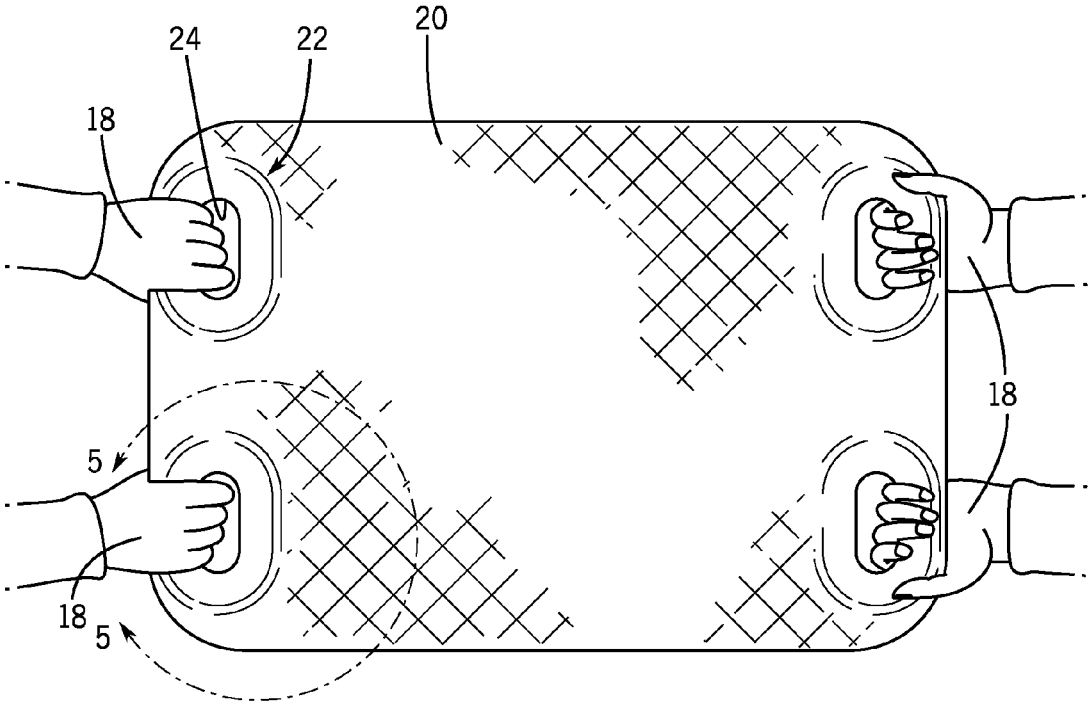
FIG. 4 is a top view of an under pad according to an exemplary embodiment of the present invention.
Figure 5:
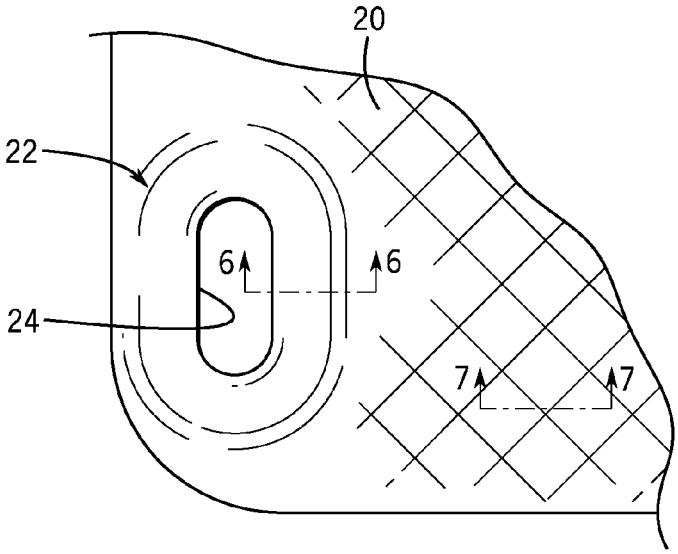
FIG. 5 is a detailed top view taken along line 5-5 of FIG. 4.
Figure 6:
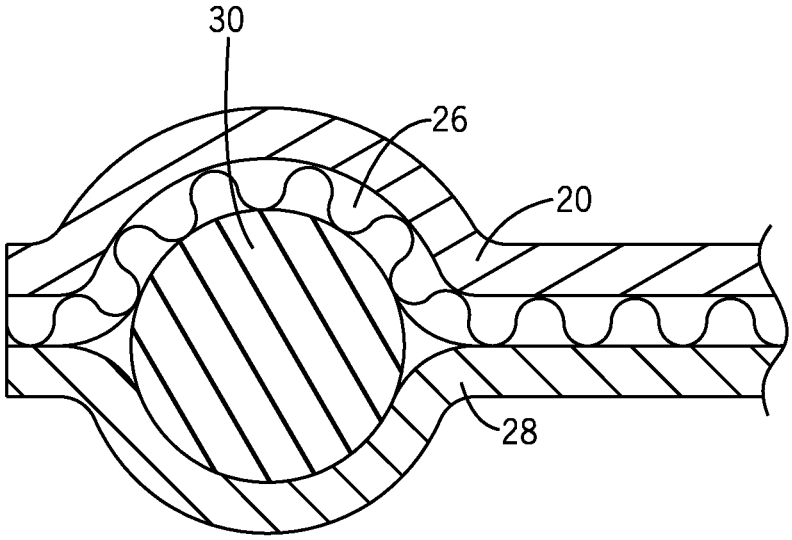
FIG. 6 is a cross-sectional view taken along line 6-6 of FIG. 5.
Figure 7:
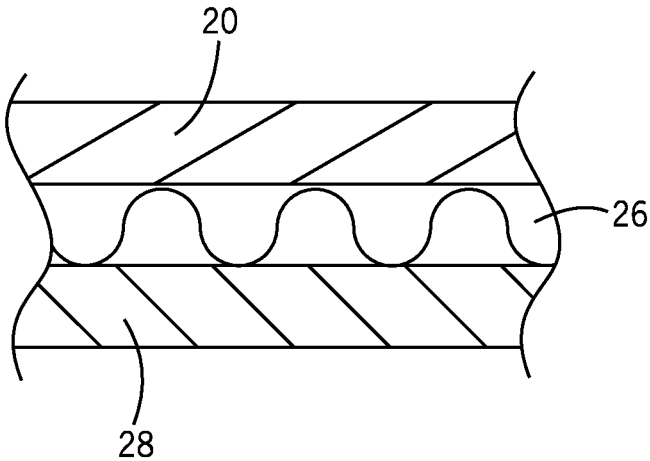
FIG. 7 is a cross-sectional view taken along line 7-7 of FIG. 5.

Referring now to FIGS. 4 through 5, an under pad 10, according to an exemplary embodiment of the present invention, may include a top layer 20, typically made from quilted cotton. The top layer 20 may be quilted/sewn with an absorbent lining 26. A non-porous waterproof barrier 28 may be attached to the absorbent lining 26 to form the bottom of the under pad 10.

At least two handles 22 may be formed in opposite sides of the under pad 10. Handle openings 24 provide a region for a caregiver 16 to insert their hands 18 to use the under pad 10. Typically, two handles 22 will be formed on each opposite side.

The handles 22 may include the top layer 20, typically made of quilted cotton. This top layer 20 may be the same material as the top layer of the under pad body. This top layer 20 may be quilted/sewn to an absorbent lining 26, similar to the under pad body described above. A foam layer 30 may be placed around the handle opening 24 to assist with a firm grip for the users. The foam layer 24 may be sewn into all three layers of the handle 22—the top layer 20, the absorbent lining 26, and the waterproof barrier 28. Finally, the handle 22 may include a non-porous waterproof barrier 28 at the bottom side thereof. Typically, the non-porous waterproof barrier 28 will be sewn into the handles 22.

The absorbent lining layer 26 may be an absorbent material that may draw moisture and wetness away from the skin of a patient 14, while the non-porous waterproof layer 28 may prevent this moisture from leaking onto bed linens, for example. The absorbent lining 26 and the quilted cotton top layer 20 may be made from various materials. While cotton may be typically used, other materials, both natural and synthetic, such as polyester, may be used.

Figure 1:
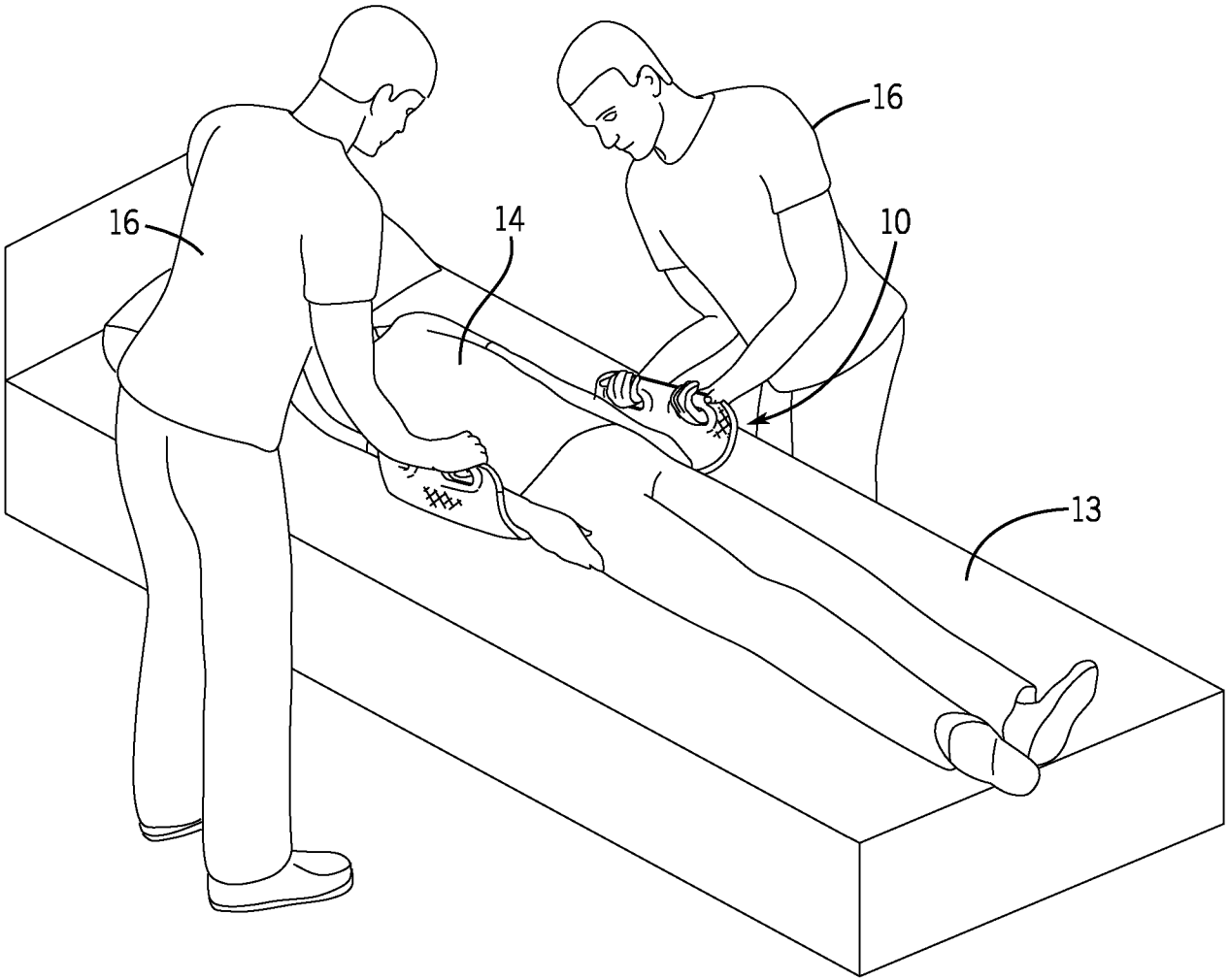
FIG. 1 is a perspective view of an under pad, according to an exemplary embodiment of the present invention, in use to help maneuver a patient in a bed.
Figure 3:
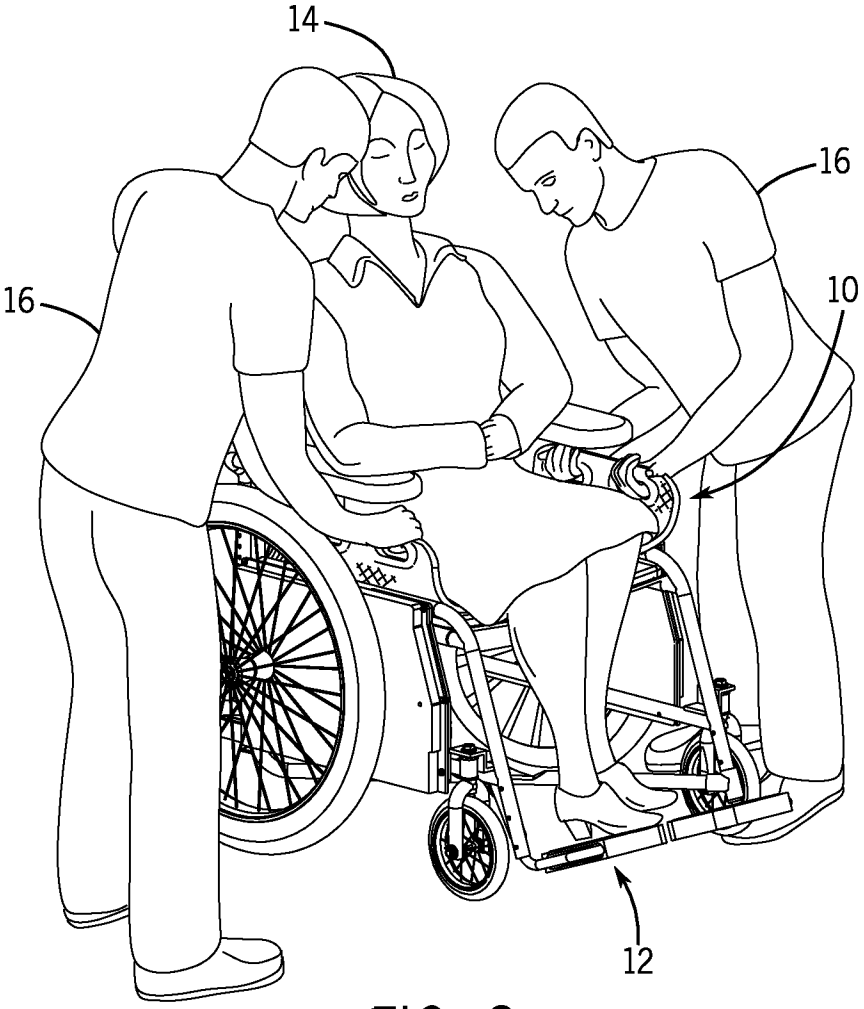
FIG. 3 is a perspective view of the under pad of FIG. 2, in use to help maneuver a patient in a wheelchair.
Figure 2:
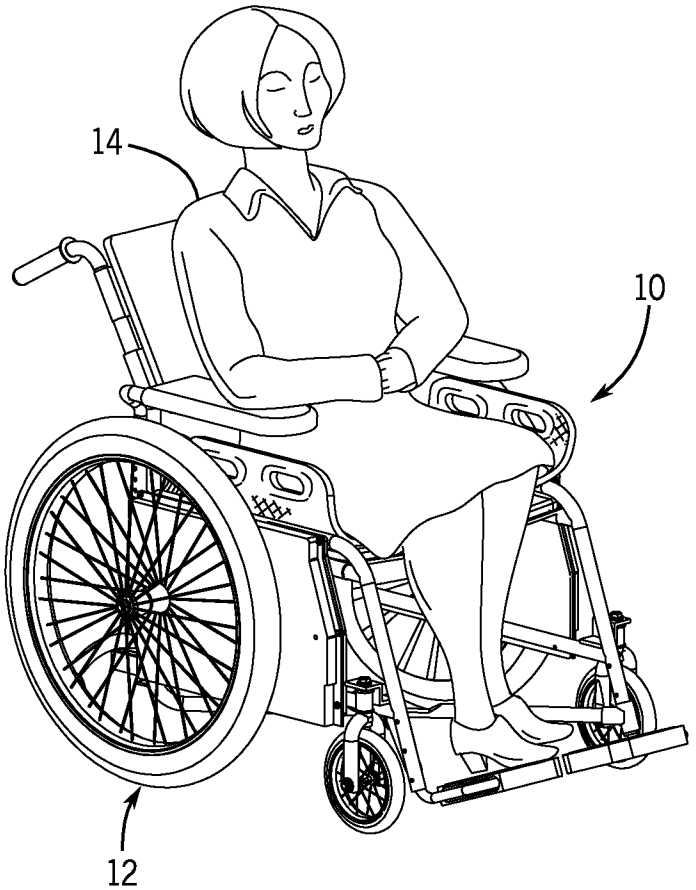
FIG. 2 is a perspective view of an under pad, in use under a patient in a wheelchair.

Referring now to FIGS. 1 through 3, the under pad 10 of the present invention may be used as an absorbent under pad for bedbound, hospitalized, or sick patients, either at home or in a clinical setting. The product may facilitate with the transfer and repositioning of patients by caregivers 16, using the handles 22 and promoting caregiver 16 proper body mechanics and patient safety.

As shown in FIG. 1, a patient 14 that is in a bed 13 can be maneuvered as may be needed for moving the patient from a lying to a sitting position or for making the bed, for example. As shown in FIGS. 2 and 3, a patient 14 that is in a wheelchair 12 can keep the under pad 10 under themselves, allowing the caregiver 16 to grasp the handles 22 to move the patient 14 out of the wheelchair 12, when needed.

The under pad of the present invention may be used in various settings in addition to those described above. For example, the under pad may be used in veterinary settings, in emergency settings to help transfer injured/wounded persons, or to help in the transfer of overweight individuals.

It should be understood, of course, that the foregoing relates to exemplary embodiments of the invention and that modifications may be made without departing from the spirit and scope of the invention as set forth in the following claims.

What is claimed is:

1. An under pad comprising:

a top layer;

an absorbent layer disposed adjacent the top layer;

a non-porous waterproof bottom layer disposed adjacent the absorbent layer;

at least two handles on opposite sides of the under pad;

a handle opening defined by each of the at least two handles;

an annular foam layer disposed below the absorbent layer and circumscribing the handle opening.

2. The under pad of claim 1, wherein the absorbent layer draws moisture and wetness away from a patient disposed on the top layer.

3. The under pad of claim 1, wherein the at least two handles includes at least two handles disposed on each of the opposite sides of the under pad.

4. The under pad of claim 1, wherein the top layer is stitched into the absorbent layer.

5. The under pad of claim 1, wherein the top layer is a quilted cotton layer.

6. The under pad of claim 1, wherein the foam layer is stitched into the top layer, the absorbent layer and the non-porous waterproof bottom layer.

7. An under pad comprising:

a top layer;

an absorbent layer adjacent the top layer, the top layer quilted into the absorbent layer;

a non-porous waterproof bottom layer disposed adjacent the absorbent layer;

at least two handles on each of two opposite sides of the under pad;

a handle opening defined by each of the at least two handles;

an annular foam layer disposed below the absorbent layer and circumscribing the handle opening, wherein the foam layer is stitched into the top layer, the absorbent layer and the non-porous waterproof bottom layer.

8. The under pad of claim 7, wherein the absorbent layer draws moisture and wetness away from a patient disposed on the top layer.

9. The under pad of claim 7, wherein the top layer is a quilted cotton layer.

10. The under pad of claim 7, wherein the handles are formed as oval openings in each corner of the under pad.

* * * * *